United States Patent [19]

Salama et al.

[11] Patent Number: 4,629,111

[45] Date of Patent: Dec. 16, 1986

[54] METHOD OF REINFORCING COMPLEX TUBULAR JOINTS

[75] Inventors: Mamdouh M. Salama, Ponca City, Okla.; Robert B. Pan, Calgary, Canada

[73] Assignee: Conoco Inc., Ponca City, Okla.

[21] Appl. No.: 664,278

[22] Filed: Oct. 24, 1984

Related U.S. Application Data

[62] Division of Ser. No. 437,605, Oct. 29, 1982, Pat. No. 4,543,008.

[51] Int. Cl.[4] ..... B23K 31/00

[52] U.S. Cl. ..... 228/182

[58] Field of Search ..... 228/182; 403/271, 272

[56] References Cited

U.S. PATENT DOCUMENTS

| | | | |
|---|---|---|---|
| 2,242,427 | 5/1941 | Heanue | 403/272 X |
| 2,842,070 | 7/1958 | Boese et al. | 403/272 X |
| 3,067,844 | 12/1962 | Hunnebeck | 52/693 X |
| 3,779,656 | 12/1973 | Guy et al. | 403/174 |
| 3,967,457 | 7/1976 | Lovie | 405/198 |
| 4,015,434 | 4/1977 | Tarrant | 405/198 |
| 4,050,830 | 9/1977 | Pavlin | 403/271 X |

*Primary Examiner*—Kenneth J. Ramsey

*Attorney, Agent, or Firm*—Stephen A. Littlefield

[57] ABSTRACT

A multicurvature reinforcing body comprising a pair of abutting bowl shaped members is fitted within a tubular chord member in the area of a complex joint. Cylindrical surfaces of contact of the multicurvature reinforcing body are positioned so that the longitudinal axis of an intersecting bracing member attached to the chord member passes through both of the surfaces of contact. The use of a multicurvature reinforcing body constitutes an improvement over the commonly used stiffening rings in that direct translation of tensional and compression forces acting along a bracing member which intersects at an angle other than perpendicular to the chord member to a large surface of contact within the chord member is effected.

4 Claims, 3 Drawing Figures

METHOD OF REINFORCING COMPLEX TUBULAR JOINTS

This is a division, of application Ser. No. 437,605 filed Oct. 29, 1982, now U.S. Pat. No. 4,543,008.

This invention relates to the art of stiffening of tubular structural components and, more particularly, to a system of internally reinforcing chord members of a large structure at the juncture of bracing members.

BACKGROUND OF THE INVENTION

Large diameter chord members employed in such structures as large towers and particularly offshore oil platform support jackets are subjected to a wide range of tensile and compressive stresses. Such stresses are particularly concentrated at points where bracing and crossing tubular members engage the side walls of the chords. At these points, tension and compression forces acting along the attached bracing members can act to buckle, punch or fatigue crack the side walls of the chord members. In the past, several means of internal reinforcement for the chord members have been employed. The overall effect of such reinforcing is to distribute tensile and compressive forces transmitted by bracing members over a larger area of the chord wall.

The most common reinforcing structure for chord members is a series of internally positioned ring structures welded to the inner walls of the chord member in the area at and adjacent to the intersection of a bracing member. Commonly, several rings are employed at spaced intervals in the area of an intersection. The weight, complexity, and cost of the complicated, multistep welding process makes such a stiffening system a disagreeable choice. Further, the generally radially oriented reinforcing rings do not effectively distribute forces acting against the side wall of the chord structure when the bracing members intersect at an angle other than perpendicular to the chord wall such as in a so-called K- or X-joint.

U.S. Pat. No. 4,130,303, describes the reinforcement of a pipe cross fitting for interconnecting tubular structural members in which plate members are disposed diametrically across the internal diameter of the intersecting structures. Tension and compression forces are concentrated at the welds at which the small abuting areas of the plate members intersect with the chord walls.

Other prior means of reinforcing tubular structures include radial web walls as described in U.S. Pat. No. 2,196,708 and crossing wooden beams which engage the inner walls of a tubular member such as described in U.S. Pat. No. 3,776,253.

None of the foregoing prior art reinforcing systems effectively distributes tensile and compressive forces acting against the side walls of a chord member at an intersection with a bracing member of the complex joint. For the purposes of this specification, a complex joint is defined as an intersection of a chord and bracing member at an angle other than perpendicular to the major longitudinal axis of the chord member.

SUMMARY OF THE INVENTION

The present invention provides an internal stiffening means for reinforcing chord members against tensile and compressive forces acting at complex joints with intersecting bracing members.

In accordance with the invention, an internal reinforcing means comprises a multicurvature reinforcing body formed by a pair of dome or bowl shaped members having facing and abutting convex surfaces and a common axis of radial symmetry. The bowl shaped members have a shape such that a cross section taken perpendicular to the axis forms a circle at the outward edges of the bowl. The circular edge portions of each of the bowls are connected to the imperforate, inner cylindrical wall of a chord member in a position such that the longitudinal axis of an intersecting brace member passes across the chord member through the outward edges of the pair of bowl shaped members at their intersection with the inner wall of the chord member.

Further in accordance with the invention, the bowl shaped members have a hemispheric, parabolic dish, conical or frusto-conical or other similar shape.

It is therefore an object of this invention to provide a more simplified internal bracing means which does not require the welding of a multitude of rings within a chord structure.

It is a further object of this invention to provide an internal reinforcing means which efficiently and effectively transfers angular forces acting along a complex joint of chord and bracing members.

BRIEF DESCRIPTION OF THE DRAWING

These and other objects of the invention are accomplished through the manner and form of the present invention to be described hereinafter in conjunction with the accompanying drawing forming a part of this specification and in which.

DETAILED DESCRIPTION OF THE PREFERRED EMBODIMENTS AND THE DRAWINGS

Figure 1:
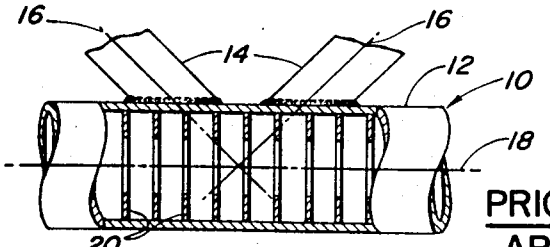
Fig. 1 PRIOR ART
FIG. 1 shows the ring stiffening system which is commonly used in the prior art and which the present invention is intended to improve upon.

Referring now to the drawings wherein the showings are for the purposes of illustrating a preferred embodiment of the invention only and not for the purpose of limiting same, FIG. 1 shows the common, prior art means of internally reinforcing chord members in the area of intersecting bracing members using reinforcing rings. A chord member 10 has attached to the outer surface 12 thereof a pair of intersecting brace members 14 having longitudinal axes 16 which intersect at an angle other than perpendicular to the longitudinal axis 18 of the chord member 10 to form a complex joint with the chord member 10. In order to reinforce the chord member 10 against tensile and compressive stresses acting on the walls of the chord member 10 through the brace members 14, a plurality of circular ring stiffeners 20 are welded internally of the chord member 10. It can be clearly seen that tensile and compressive forces acting along a perpendicularly intersecting brace member would be translated by the ring stiffeners 20 to the entire circumference of the chord member 10. This is not the case, however, with the brace members 14 which form a complex joint with the chord member 10. Since the forces acting along the brace members 14 are not radially disposed with respect to the longitudinal axis of the chord member 10, the radially disposed circular ring stiffeners 20 do not effectively distribute the forces acting along the brace members 14. For this reason, a great number of internal ring stiffeners 20 must be employed in order to reinforce the chord member 10 at the intersection of these bracing members 14.

Figure 2:
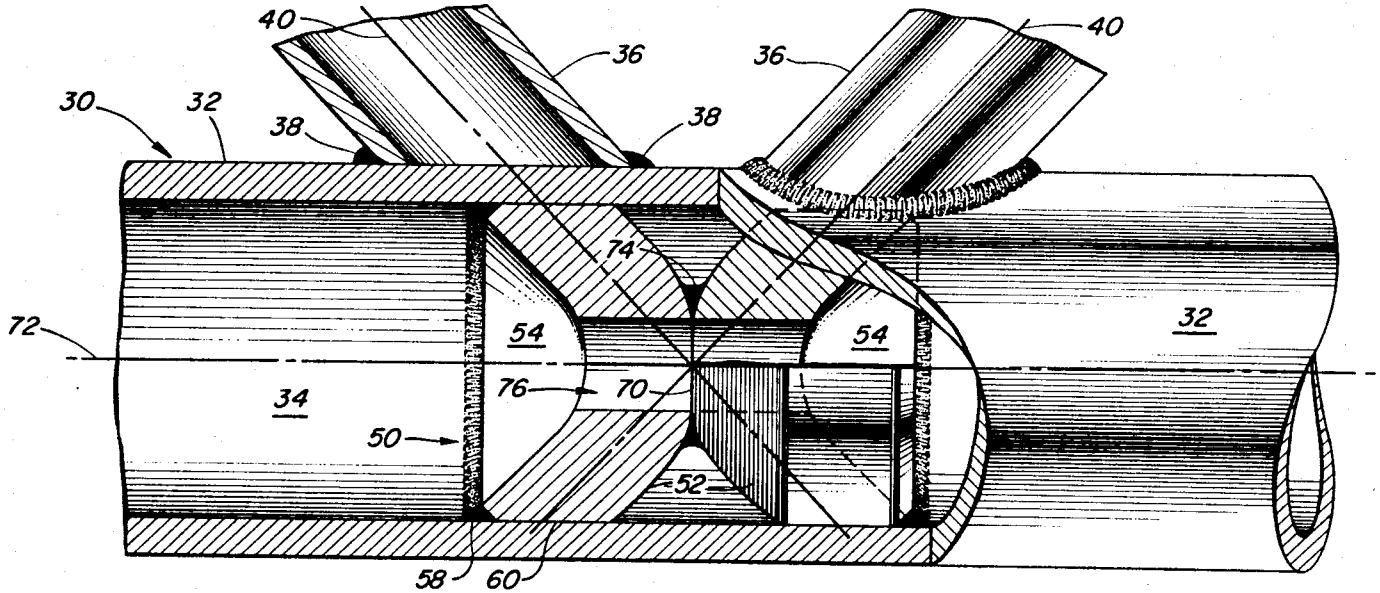
FIG. 2 is a fragmentary, side elevational view of a complex joint of a chord and bracing members showing the multicurvature internal reinforcing means of the present invention.
Figure 3:
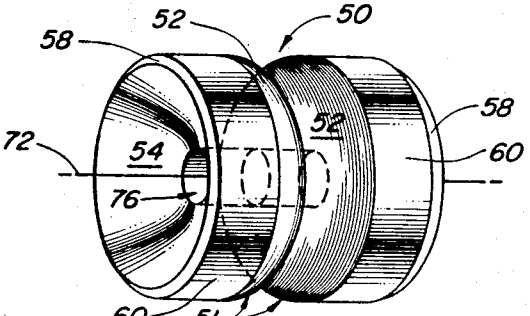
FIG. 3 is a perspective view of one form of multicurvature internal reinforced means which may be used in the structure shown in FIG. 2.

The preferred embodiment of the invention shown in FIGS. 2 and 3 overcomes the problem of efficient transmission of forces from a bracing member which intersects with a chord member at an angle other than perpendicular to the longitudinal axis of the chord member. As shown in the Figures, a tubular chord member 30 has an outer surface 32 and an inner surface 34. A pair of tubular bracing members 36 are attached as by welding to the imperforate outer surface 32 of the tubular chord member 30 by weld beads 38. The chord 30 and bracing members 36 form a complex joint which is commonly referred to as a K-joint.

In order to reinforce the chord member 30 against tension and compression forces acting along the central axes 40 of the bracing members 36, a multicurvature reinforcing body, generally designated as 50, is located within the tubular chord member 30 in accordance with the present invention. The multicurvature reinforcing body 50 acts in conjunction with the tubular walls of the tubular chord member 30 to spread the compression and tension forces acting on the bracing members 36 over a wide area of the tubular chord member 30.

In accordance with the invention, the multicurvature reinforcing body 50 generally comprises a pair of bowl shaped members 51 having abutting convex surfaces 52 and oppositely outwardly facing concave surfaces 54. Each of the bowl shaped members 51 has a circular edge portion 58 which is preferably welded to the cylindrical inner surface 34 of the chord member 30. Because of the thickness of each of the bowl shaped members 51, there is a pair of substantially cylindrical surfaces of contact 60 located adjacent the circular edge portions 58 of each of the bowl shaped members 51, the cylindrical surfaces of contact 60 being generally in abutment against the cylindrical inner surface 34 of the tubular member 30. As can be seen in the Figures, the central axes 40 of each of the bracing members 36 acts along a line passing through the cylindrical surfaces of contact 60 of each of the bowl shaped members 52. In this manner, forces acting along the central axes 40 of the bracing members 36 are transmitted directly by the multicurvature reinforcing body 50 over a large area of the inner surface 34 of the chord member 30.

Assembly of the multicurvature reinforcing body 50 within the chord member 30 may be accomplished during structural fabrication. As stated above, the multicurvature reinforcing body 50 is preferably welded at its edges 58 to the inner surface 34 of the chord member 30 to locate it in its proper position. Location may also be effected by shrink fitting or a combination of shrink fitting and welding, as preferred.

Forces acting on the bracing members 36 are transferred from one bowl shaped portion 51 of the multicurvature reinforcing body 50 through the central abutment 70 of the bowl shaped portions 51. The central abutment 70 is centered on the longitudinal axis 72 of the tubular chord member 30. As illustrated in the Figures, the two bowl shaped members 51 are welded together by a weld bead 74 extending around the central abutment 70. It will be understood that the connection of the bowl shaped members 51 by a weld 74 is a matter of design convenience and is preferred but that mere unconnected abutment of the bowl shaped members 51 would be sufficient to transfer at least compressive forces in accordance with this invention. Alternatively, it would be possible to make the multicurvature reinforcing body 50 as a single piece (such as by casting, forging or machining) comprising two diverging, outwardly opening bowl halves which are joined in their bases.

In the embodiment shown in FIGS. 2 and 3, a central cylindrical opening 76 is provided through the multicurvature reinforcing body 50 so that there is communication between the chambers defined outwardly away from the multicurvature reinforcing body 50 within the tubular chord member 30. Such central openings 76 are not required within the scope of the invention but may be provided, as required, in the structure of which the chord and bracing members 30 and 36 are a part.

As illustrated in the Figures, the bowl shaped members 51 have the form of a hollow spherical segment. It will be understood that this is merely one preferred form of bowl shape which may be used in accordance with this invention. Other forms which may be used and considered as being defined by the term "bowl shape" include a spheric segment, paraboloid, hyperboloid, conical-or frusto-conical-shaped member or any other similar dished, domed or other similarly formed member. The bowl-shaped member contemplated by this invention may be further characterized as having a shape in which the radius decreases in a regular manner from the edge portions to the center and a cross section through the bowl-shaped member perpendicular to its axis defines a circle.

It can be seen that the shape of the multicurvature reinforcing body 50 can be altered to accomodate a broad range of intersecting angles for the bracing members 36 and braces on other planes that are not shown in FIG. 2. Thus, as the angle of incidence of the bracing members 36 approaches an angle perpendicular to the outer surface 32 of the tubular chord member 30, bowl shaped members 51 having an increased radius of curvature may be used in the multicurvature reinforcing body 50. Similarly, bowl shaped members 52 having a decreased radius of curvature would be utilized at angles which increasingly depart from the perpendicular for the intersections of bracing members 36 and the tubular chord member 30.

The figures also illustrate that the bowl shaped members 51 have oppositely outwardly facing concave surfaces 52. It will be understood that this is merely a preferred form for the bowl shaped members 51 which results in a weight savings over a bowl shaped member 51 whose oppositely outwardly facing surfaces would be planar and extending from the circular edge portions 58. It will therefore be understood that the scope of this invention shall include other solid shapes having a bowl shaped outer surface as defined hereinabove which do not have a hollowed out form as illustrated in the Figures.

While the invention has been described in the more limited aspects of the preferred embodiment thereof, other embodiments have been suggested and still others will occur to those skilled in the art upon the reading and understanding of the foregoing specification. It is intended that all such embodiments be included within the scope of this invention as limited only by the appended claims.

Having thus described our invention, we claim:

1. A method of reinforcing a complex joint of a tubular chord member having cylindrical inner and outer surfaces and a tubular bracing member having a longitudinal axis, the tubular bracing member being attached to the outer surface of the chord member, the method comprising locating a multicurvature reinforcing body internally of the chord member, the multicurvature reinforcing body having a pair of cylindrical surfaces of contact in abutment with the inner surface of the chord member, the multicurvature reinforcing body being located so that the longitudinal axis of the bracing member passes through both of the pair of cylindrical surfaces of contact of the multicurvature reinforcing body.

2. The method of reinforcing a complex tubular joint as set forth in claim 1 wherein the step of locating comprises shrink fitting the multicurvature reinforcing body into abutment against the cylindrical inner surface of the chord member.

3. The method of reinforcing a complex tubular joint as set forth in claim 2 wherein the step of locating further includes the step of welding the multicurvature reinforcing body to the cylindrical inner surface of the chord member.

4. The method of reinforcing a complex tubular joint as set forth in claim 1 wherein the step of locating comprises welding the pair of cylindrical surfaces of contact of the multicurvature reinforcing body to the cylindrical inner surface of the tubular chord member.

* * * * *